United States Patent [19]

Nuuttila et al.

[11] 4,432,805

[45] Feb. 21, 1984

[54] METHOD FOR CONTINUOUS SACCHARIFICATION OF CELLULOSE OF PLANT RAW MATERIAL

[75] Inventors: Antti I. Nuuttila, Tampere; Veikko J. Pohjola, Veikkola, both of Finland

[73] Assignee: Oy Tampella AB, Finland

[21] Appl. No.: 391,442

[22] Filed: Jun. 23, 1982

Related U.S. Application Data

[63] Continuation of Ser. No. 217,514, Dec. 17, 1980, abandoned.

[30] Foreign Application Priority Data

Dec. 18, 1979 [FI] Finland ..... 793963

[51] Int. Cl.[3] ..... C13K 1/02

[52] U.S. Cl. ..... 127/37; 127/1

[58] Field of Search ..... 127/37, 1

[56] References Cited

U.S. PATENT DOCUMENTS

| | | | |
|---|---|---|---|
| 2,086,701 | 7/1937 | Dreyfus | 127/37 |
| 2,840,605 | 6/1958 | Leonard | 127/37 X |
| 3,079,304 | 2/1963 | Thomsen | 127/37 X |
| 3,212,932 | 10/1965 | Hess et al. | 127/37 |
| 3,212,933 | 10/1965 | Hess et al. | 127/37 |
| 4,029,515 | 6/1977 | Kiminki et al. | 127/37 |
| 4,199,371 | 4/1980 | Regnault et al. | 127/37 |
| 4,237,110 | 12/1980 | Forster et al. | 127/37 X |

FOREIGN PATENT DOCUMENTS

| | | |
|---|---|---|
| 1642534 | 5/1971 | Fed. Rep. of Germany . |
| 130582 | 4/1978 | Fed. Rep. of Germany . |
| 170628 | 3/1978 | Hungary . |
| 178620 | 3/1975 | Poland . |
| 205735 | 3/1978 | Poland . |

*Primary Examiner*—Kenneth M. Schor

*Attorney, Agent, or Firm*—Roylance, Abrams, Berdo & Goodman

[57] ABSTRACT

A method for continuous saccharification of plant raw material by feeding the raw material as such or prehydrolyzed and a dilute sulphuric acid solution into a flow reactor in order to hydrolyze the raw material under pressure and at a high temperature, discharging dry solids and liquid from the reactor by expansion and separating liquid and solids, wherein the raw material and sulfuric acid solution are led through the reactor at equal rate, which is the same as required by the more easily hydrolyzable particles of the raw material, the solids and liquid together are discharged into the same blow tank and at least part of the separated coarse solid is returned into the reactor.

8 Claims, 1 Drawing Figure

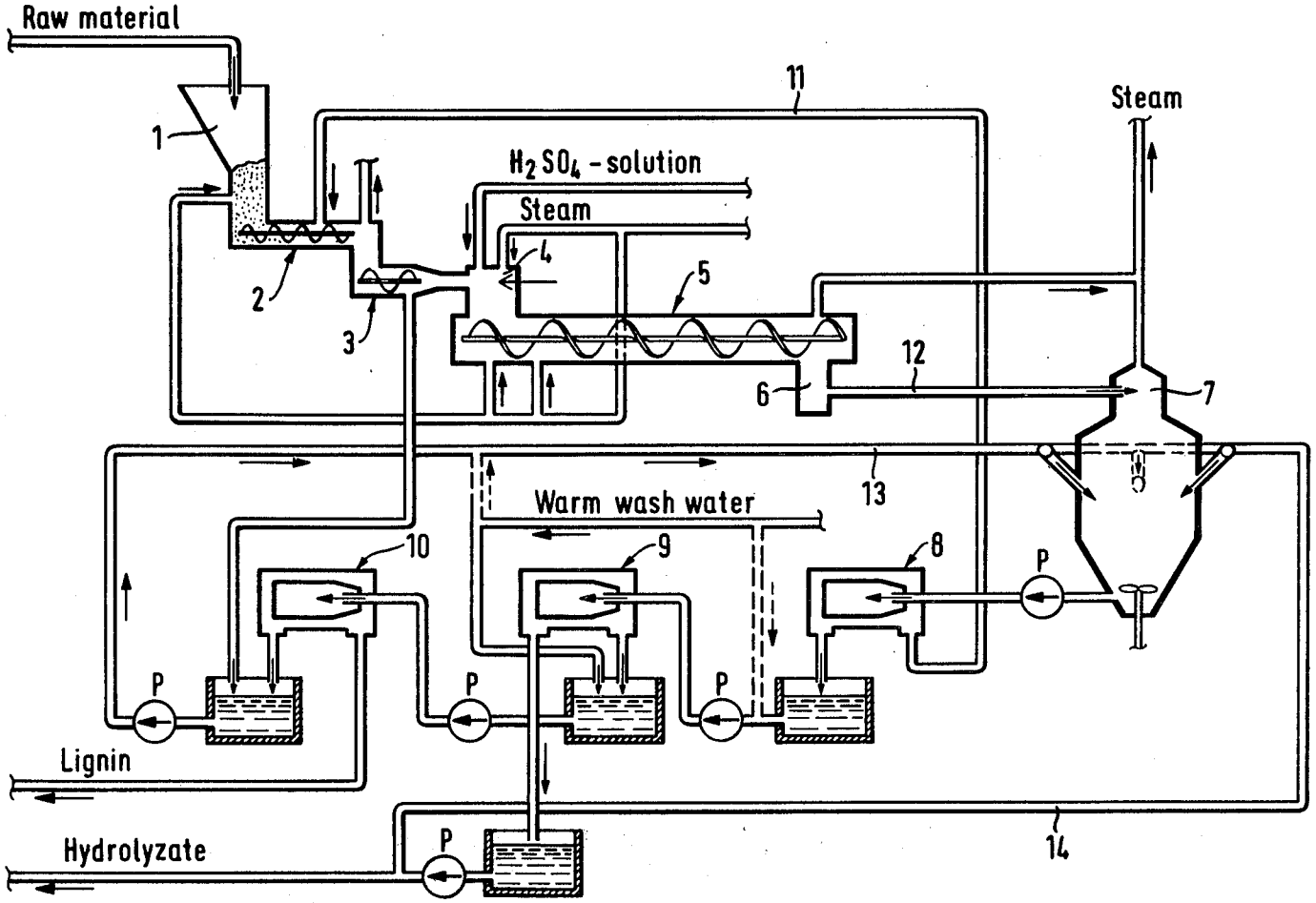
Steam
7
14
P
8
12
13
11
6
5
$H_2SO_4$ - solution
Steam
4
Warm wash water
9
P
P
P
10
3
2
1
Raw material
Lignin
Hydrolyzate

METHOD FOR CONTINUOUS SACCHARIFICATION OF CELLULOSE OF PLANT RAW MATERIAL

This is a continuation of application Ser. No. 217,514, filed Dec. 17, 1980 and now abandoned.

BACKGROUND OF THE INVENTION

This invention relates to a method for continuous saccharification of cellulose of plant raw material by feeding raw material and/or the same material prehydrolyzed and a dilute sulfuric acid solution into a flow reactor in order to hydrolyze the raw material in pressurized atmosphere at high temperature, by discharging solid and liquid from the reactor by expansion and by separating the liquid containing sugars from the solid.

The present invention thus relates to a method for decomposing the hemicellulose and cellulose contained in various plant materials by hydrolysis into monosaccharides with diluted acid. The monosaccharides are useful raw materials both for the chemical and microbiologic industries. While the prices of petrochemical products are continuously rising the prices of products which are based on plant raw material such as for example ethanol and its derivates and protein are gradually becoming competitive and interest taken in these products is continuously growing. The object of the present invention is to accomplish a method for producing monosaccharides from cellulose-containing plant materials which can be used as raw materials for chemical and microbiologic industries.

All materials containing cellulose or lignocellulose, such as paper waste, straw, bagasse, saw dust, wood chips and peat are suitable for the method according to the invention.

Several processes are known to hydrolyze plant raw materials containing cellulose with a dilute water solution of sulfuric acid. These known processes are mainly based on the so-called Scholler process which was one of the first hydrolysis processes industrially applied. In the Scholler process plant raw material is hydrolyzed in batches in a percolator. In the first treatment a dilute sulfuric acid solution is led through the plant raw material to be hydrolyzed at a temperature of 150°-160° C., and in the second treatment a little stronger sulfuric acid at 180°-200° C. is led through the treated plant raw material as quickly as possible in order to prevent decomposition of the hydrolyzed sugars.

A disadvantage of the Scholler process is the very long duration of the treatment which takes many hours and demands thus several expensive and bulky percolators, besides which the sugar content of the hydrolyzate and the sugar yield remain low. In addition to this it has proven to be difficult to make liquid pass evenly through the plant raw material to be hydrolyzed because during the progress of the hydrolysis the plant material becomes finer and channels are built in it through which the liquid passes while the material between the channels remains substantially unhydrolyzed.

Finnish Pat. No. 51370 discloses a method for continuous saccharification of cellulose of solid plant raw material wherein the plant raw material is continuously hydrolyzed in one reactor in two stages. The continuous flow reactor for the main hydrolysis is set below the prehydrolysis reactor and is an immediate continuation thereof. In the reactor the liquid flows faster than the solid particles, in other words the liquid flows through the plant raw material to be hydrolyzed in accordance with percolation principle. The disadvantages associated with the Scholler process are not eliminated by this process either. Also in this case channels are formed in the solid material. Liquid flows through these channels while the material between the channels remains substantially unhydrolyzed.

In the method according to this patent residue and liquid are discharged from the reactor by means of expansion; by blowing the liquid and the residue separately through the reactor bottom into blow tanks. Similarly to the Scholler process, also here relatively great amounts of water are used, i.e. 9 to 3 kilos of liquid to one kilo of dry solids contained in the raw material. When the residue is blown from the reactor separately, it is possible to evaporate liquid from the residue.

The plant raw material, however, contains different kinds of particles, some of which are hydrolyzed quicker than the others. In percolation type processes this is taken into consideration by letting liquid flow through the reactor faster than solid. Thus the more easily hydrolyzed particles can be discharged from the reactor earlier than the less easily hydrolyzable ones, and so the yield of sugar is increased. However, it has turned out that when liquid and solid are flowing at different speeds in the reactor, channels are formed in the solid through which the liquid mainly passes. Therefore a great part of the solid does not react and contains still unhydrolyzed particles when leaving the reactor.

The object of the present invention is to eliminate the above-mentioned disadvantages and to provide a method for continuous separation of sugar from plant raw material with high sugar yield, high sugar content and low energy consumption as well as at the lowest possible investment costs.

SUMMARY OF THE INVENTION

The disadvantages associated with above-mentioned percolation type processes are thus eliminated in the present invention by leading raw material and weak sulfuric acid solution through the reactor at equal speed, which is the same as required by the more easily hydrolyzable particles of the raw material, by discharging solid and liquid together into the same blow tank and by returning at least part of the separated coarse solid into the reactor. The liquid and the solid thus pass at the same speed downstream through the reactor. Thus no channels caused by different speeds of liquid and solid are formed in the solid, but liquid and solid are evenly mixed together. When liquid and solid are blown into the same tank, the size of solid particles is reduced and the accessibility of the solid increases.

Breaking up the structure of cellulosic material is especially important when the low ratio of liquid and solid is used, whereby volatile substances leave the fibre explosively when the cellulosic solid is blown off from the pressurized reactor. After the blow the partly unreacted, still richly cellulosic coarse particles are returned into the hydrolysis reactor, while the fine, lignin containing particles which have already reacted are discharged from the process together with the hydrolyzate.

Due to the repeated blows the size of the coarser particles which still contain plenty of cellulose, is thus reduced and is inversely proportional to the lignin content. The lignin-rich fraction can thus be separated and removed from the cycle on the basis of particle size so that a high recycle ratio can be applied. This contributes to high yield of sugar and selectivity, because the amount of byproducts is small. The small amount of liquid causes small demand of heating steam and sulfuric acid, and the operation costs of the process are decreased.

From the high recycle ratio follows a short reaction time and, simultaneously with the main hydrolysis, a high yield of pentoses and/or furfural can be produced from pentosans.

The raw material used in the method according to the invention can be either raw cellulosic plant material or prehydrolyzed material.

The low liquid/solid ratio and the removal of hydrolyzed solid from the hydrolysis reactor decrease the size of the reactor and reduce thus the investment costs. High yield of sugar is possible at low liquid/solid ratio and the hydrolyzed lignin-rich material does not demand reactor space.

The reactor is preferably a tube reactor with a screw conveyor. The hydrolyzed solid is continuously blown into a blow tank together with liquid, the blown substance is washed in a separator, the coarser, unreacted material is returned into the hydrolysis reactor and the lignin-rich, hydrolyzed material is mixed with wash water and brought to a separator where lignin concentrate and hydrolyzate are separated from each other. The lignin concentrate is once more washed with water which is then brought back into the blow tank as wash water.

The weight ratio of liquid and solid in the reactor is thus lower than usual, about 1-5 and preferably 2.5-3. The recycle ratio can be controlled by adjusting the ratio between the amount of solid returned to the reactor and the amount of solid discharged from the reactor. This ratio is preferably 60-90% and the detention time is correspondingly 20-5 minutes in the reactor. Temperature inside the reactor is kept at about 150°-220° C. and pressure is kept at the reading corresponding to this pressure whereby the sulfuric acid content is 2-0.1 percent of weight.

DESCRIPTION OF THE DRAWING

A flow diagram of a preferred embodiment of the invention is illustrated by the FIGURE.

DESCRIPTION OF THE PREFERRED EMBODIMENT

The plant raw material is brought on a conveyor to a bin 1, and preheated in its lower section by direct steam to about 90° C. In the lower section of bin 1 there is a double screw discharger 2 which continuously distributes the material into a screw feeder 3. The middle section of the double screw discharger 2 receives from conveyor 11 also the recycling solid which is mixed with the new raw material before it is fed into the front space 4 of the reactor 5.

The screw feeder 3 is the actual doser for raw material. At the same time it acts as a pressure seal in the feed opening of the reactor 4. When the raw material comes into the front space 5 it is mixed with pressure-adjusted heating steam and a weak, about 3% sulfuric acid solution the temperature of which is at least 90° C. The detention time in the reactor 5 of the raw material suspension of which the liquid-solid ratio is about 2.5-3 is adjusted by the rotation speed of the set screw of the reactor 5. The temperature in the reactor 5 is preferably about 180°-200° C., the detention time is 7-15 minutes depending on the recycle ratio and the sulfuric acid content of the liquid is about 1-0.25% which corresponds to the above-mentioned temperatures.

From the discharger 6 of the reactor 5 the suspension is blown continuously into blow tank 7 where steam evaporates at 100° C. and solid is diluted to a thickness suitable for pumping. The diluent used is composed of the hot lignin wash water from pipe 13, obtained from the third separation stage 10, and of hydrolyzate from pipe 14. By controlling the ratio of wash water 13 and hydrolyzate 14 the sugar content of the produced liquor can be increased and preset for example at 100 g/l.

The suspension of the blow tank 7 containing once or several times blown raw material, dissolved sugars etc. and 90° C. water is pumped to the first stage separator 8. Here coarse solids are separated from hydrolyzate and lignin and returned on conveyor 11 to the double screw discharger 2 of the bin and further back to the reactor 5.

The liquid fraction (hydrolyzate and fine solid fraction which is mainly lignin) is pumped from separator 8 to the second stage separator 9 where lignin is separated from the product (hydrolyzate).

About two thirds of the solid fraction of separator 9 is hydrolyzate i.e. sugars. In order to recover these the solid fraction is diluted with hot wash water and pumped to third stage separator 10 the liquid fraction of which receives the major part of the remaining sugars. The liquid fraction is led through pipe 13 into the blow tank where it is diluted and the sugars return to the cycle.

The solid fraction of separator 10 is mainly pure lignin. Its solid content is about 33 percent.

In the following the invention will be described in more detail by examples.

EXAMPLE 1—EFFECT OF THE BLOW ON HYDROLYZABILITY

When raw material which is not pretreated, in this case softwood saw dust, is hydrolyzed continuously in a tube reactor with a solution containing sulfuric acid 0.25 percent of weight at a temperature of 200° C., the liquid-solid ratio being 2.5, the maximal glucose yield is obtained when the reaction time is 21 minutes. Glucose yield is then 38% of the cellulose of the original material, taking into account the losses caused when the hydrolysis residue is washed once with water and the glucose concentration is 100 g/l.

When the prehydrolyzed and once blown softwood sawdust is hydrolyzed under the same conditions as above the maximal glucose yield is obtained when the reaction time is 17 minutes. Glucose yield is then 46.4% of the cellulose contained in the original material.

EXAMPLE 2—THE EFFECT OF REPEATED BLOWS AND RECYCLE ON PREHYDROLYZED STRAW

The results are evident from Table 1. The recycle ratio means the ratio of solid returned into the hydrolysis reactor to the amount of solid discharged from the reactor. In other words, when the recycle ratio is 100% all unreacted material is being returned.

TABLE 1

| Recycle ratio | Reaction time | Glucose yield/ cellulose contained in the original material |
|---|---|---|
| 0 | 17 min | 46% |

TABLE 1-continued

| Recycle ratio | Reaction time | Glucose yield/ cellulose contained in the original material |
|---|---|---|
| 58% | 11 min | 64% |
| 73% | 9 min | 72% |
| 80% | 7.5 min | 76% |
| 85% | 6.5 min | 79% |
| 88% | 6 min | 80% |

The above Table 1 shows that when maximal glucose yield is the aim the reaction time on one cycle decreases when the recycle ratio increases. Therefore recycling does not increase the need of reactor volume.

The following Table 2 shows the effect of repeated cycles on the fraction size.

TABLE 2

| Diameter mm | Cumulative particle size distribution, % | | | |
|---|---|---|---|---|
| | Original saw dust | 1st cycle residue | 2nd cycle residue | 3rd cycle residue |
| 2.83 | 91.8 | 99.3 | | |
| 2.00 | 83.1 | 97.4 | | |
| 1.68 | 73.5 | 96.4 | | |
| 1.41 | — | 93.7 | 99.1 | |
| 1.19 | 53.1 | 90.0 | 98.4 | |
| 1.00 | — | 87.1 | 97.4 | |
| 0.84 | 32.9 | 79.8 | 95.6 | |
| 0.71 | — | 72.9 | 93.5 | 98.3 |
| 0.50 | — | 56.2 | 86.2 | 94.9 |
| 0.35 | — | 40.3 | 76.8 | 89.4 |
| 0.25 | 2.4 | 27.7 | 65.8 | 78.8 |
| 0.177 | — | 19.7 | 56.8 | 68.1 |
| 0.125 | — | 14.1 | 46.5 | 56.2 |
| 0.87 | — | 10.7 | 40.7 | 49.6 |
| 0.062 | — | 7.55 | 32.6 | 39.8 |
| 0.044 | — | 5.75 | 26.6 | 32.2 |
| 0.037 | — | 5.33 | 21.7 | 30.8 |

Cumulative particle size distribution of such fractions in water suspension which have passed through a 0.037 millimeter sieve, %

| Diameter mm | 2nd cycle residue | 3rd cycle residue |
|---|---|---|
| 0.040 | 100 | 99 |
| 0.035 | 92.5 | 92.5 |
| 0.030 | 79 | 78 |
| 0.025 | 63 | 61 |
| 0.020 | 45 | 45 |
| 0.015 | 27 | 28 |
| 0.00 | 11.5 | 12.5 |
| 0.005 | 2 | 2 |

EXAMPLE 3—THE EFFECT OF TEMPERATURE ON SULFURIC ACID CONCENTRATION

It was found out that while the reaction time being constant a temperature rise of 10° C. decreases the demand of sulfuric acid concentration to one half as shown by Table 3.

TABLE 3

| t° C. | 170 | 180 | 190 | 200 | 210 | 220 |
|---|---|---|---|---|---|---|
| $H_2SO_4$, % of weight | 2.0 | 1.0 | 0.5 | 0.25 | 0.15 | 0.1 |

An increase of reaction time decreases the temperature and sulfuric acid concentration when the same glucose yield is desired.

What is claimed is:

1. A method for continuous saccharification of a plant raw material comprising:

feeding both the raw material and a dilute sulfuric acid solution through a flow reactor at a flow rate required to hydrolyze under pressure and at elevated temperature the more easily hydrolyzable particles of the raw material and maintaining the pressure and temperature required for hydrolysis in the reactor, the detention time of said raw material and said dilute sulfuric acid in said flow reactor being substantially equal;

discharging dry solids and liquid containing monosaccharides together from the reactor into a common blow tank by expansion;

separating in a separator the liquid and solids into one fraction containing liquid and fine solids and a second fraction containing coarse solids and recovering the liquid as a monosaccharide product while discharging the fine solids which contain mainly lignin; and recycling at least part of the separated coarse solids into the reactor.

2. The method of claim 1, in which the plant raw material and sulfuric acid solution are fed into the reactor so that the weight ratio of liquid and solids in the reactor is about 1–5.

3. The method of claim 2, in which the weight ratio is 2.5–3.

4. The method of claim 1 or 2, in which the amount of solids recycled into the reactor is about 60–90% of the amount of solids discharged from the reactor, the detention time in the reactor being about 20–5 minutes, respectively.

5. The method of claim 1, in which the temperature in the reactor is kept at about 150°–200° C. and the sulfuric acid concentration in the reactor is kept at 2–0.5% by weight, respectively.

6. The method of claim 1, in which the solids are diluted in the blow tank by addition of wash water from the solids separation step or hydrolyzate or both.

7. The method of claim 1, wherein the reactor is a tube reactor equipped with a screw conveyor.

8. The method of claim 1, in which the raw material is at least partially prehydrolyzed in a separate unit.

* * * * *